US008727402B2

(12) United States Patent
Bejune et al.

(10) Patent No.: US 8,727,402 B2
(45) Date of Patent: May 20, 2014

(54) DEFORMATION DRIVEN BLOCKING MECHANISM FOR AN AUTOMOBILE

(71) Applicant: Ford Global Technologies, LLC, Dearborn, MI (US)

(72) Inventors: Daniel Carl Bejune, Southfield, MI (US); Charles Gregory Bambanek, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 106 days.

(21) Appl. No.: 13/628,387

(22) Filed: Sep. 27, 2012

(65) Prior Publication Data

US 2014/0084603 A1 Mar. 27, 2014

(51) Int. Cl.
*E05B 3/00* (2006.01)

(52) U.S. Cl.
USPC ..... 292/336.3; 292/DIG. 22

(58) Field of Classification Search
CPC ..... E05B 85/16; E05B 85/18; E05B 77/04; E05B 77/06
USPC ..... 292/198, 336.3, DIG. 22, DIG. 65
See application file for complete search history.

(56) References Cited

U.S. PATENT DOCUMENTS

| | | | | |
|---|---|---|---|---|
| 7,648,192 | B2 | 1/2010 | Herline et al. | |
| 2005/0218668 | A1 * | 10/2005 | Sakamoto et al. | 292/336.3 |

FOREIGN PATENT DOCUMENTS

| | | | |
|---|---|---|---|
| DE | 102008062214 | A1 | 7/2010 |
| GB | 2361675 | A | 10/2001 |
| JP | 2005325569 | A | 11/2005 |
| JP | 2008189076 | A | 8/2008 |
| JP | 2010132057 | A | 6/2010 |
| WO | WO 2004059112 | A1 * | 7/2004 |

* cited by examiner

*Primary Examiner* — Kristina Fulton
*Assistant Examiner* — Christine M Mills
(74) *Attorney, Agent, or Firm* — Raymond Coppiellie; Price Heneveld LLP

(57) ABSTRACT

An exterior handle assembly for a vehicle door includes a movable handle member and a mounting structure. The mounting structure includes a predefined fracture line or line of weakening, whereby the reinforcing structure fractures along the line of weakening in the event a large external force is applied to the reinforcing structure. The handle assembly also includes a push surface that pushes against an inertia lock lever after fracture of the reinforcing structure to thereby push the inertia lock lever into a locked position to prevent unlatching of a vehicle door.

20 Claims, 7 Drawing Sheets

DEFORMATION DRIVEN BLOCKING MECHANISM FOR AN AUTOMOBILE

FIELD OF THE INVENTION

The present invention generally relates to outside door handle assemblies for motor vehicles, and in particular to an outside handle assembly and bezel.

BACKGROUND OF THE INVENTION

Various types of exterior door handle assemblies for motor vehicles have been developed. A known type of handle utilizes a handle strap that is pivotably mounted to a handle reinforcement structure at a first end of the handle strap. A second end of the handle strap includes a hook or extension that is operably connected to a door latch by a rod or other suitable connecting arrangement. A handle bezel is attached to the handle reinforcement, and includes an outwardly facing finished surface that may include a pocket that receives a user's fingers behind the handle strap. Outward rotation of the handle by a user causes the rod to shift, thereby unlatching the door. The handle may include an inertia lock assembly including an inertia lock that rotates to a locked position to prevent outward rotation of the handle strap, and thereby prevent release of the latch when the handle assembly is subject to an acceleration force.

SUMMARY OF THE INVENTION

One aspect of the present invention is an exterior door handle assembly for motor vehicles. The handle assembly includes a bezel structure having inner and outer opposite sides and a peripheral portion extending around the bezel structure. A handle member is movably mounted to the bezel structure for movement between open and closed positions. The handle member is configured to be operably connected to a door latch to unlatch the door latch when the handle member is in the open position. The handle assembly further includes an inertia lock member movably mounted to a first portion of the bezel structure and moving from a rest position to an actuated position when subject to acceleration. The inertia lock member permits movement of the handle member from the closed position to the open position when the inertia lock member is in the rest position. The inertia lock member prevents movement of the handle member to the open position when the inertia lock member is in the actuated position. The handle assembly further includes a pushing surface on a second portion of the bezel structure. The first portion of the bezel structure defines a first bending strength, and the second portion of the bezel structure defines a second bending strength. The bezel structure includes an intermediate portion disposed between the first and second portions of the bezel structure defining a bending strength that is significantly less than the first and second bending strengths such that the intermediate portion of the bezel structure deforms and causes the pushing surface to contact the inertia lock member and prevent movement of the inertia lock member to its rest position when the bezel structure is subject to a bending force to thereby prevent movement of the handle member to its open position.

These and other aspects, objects, and features of the present invention will be understood and appreciated by those skilled in the art upon studying the following specification, claims, and appended drawings.

BRIEF DESCRIPTION OF THE DRAWINGS

In the drawings:

FIG. 1;

DETAILED DESCRIPTION OF THE PREFERRED EMBODIMENTS

Figure 1:
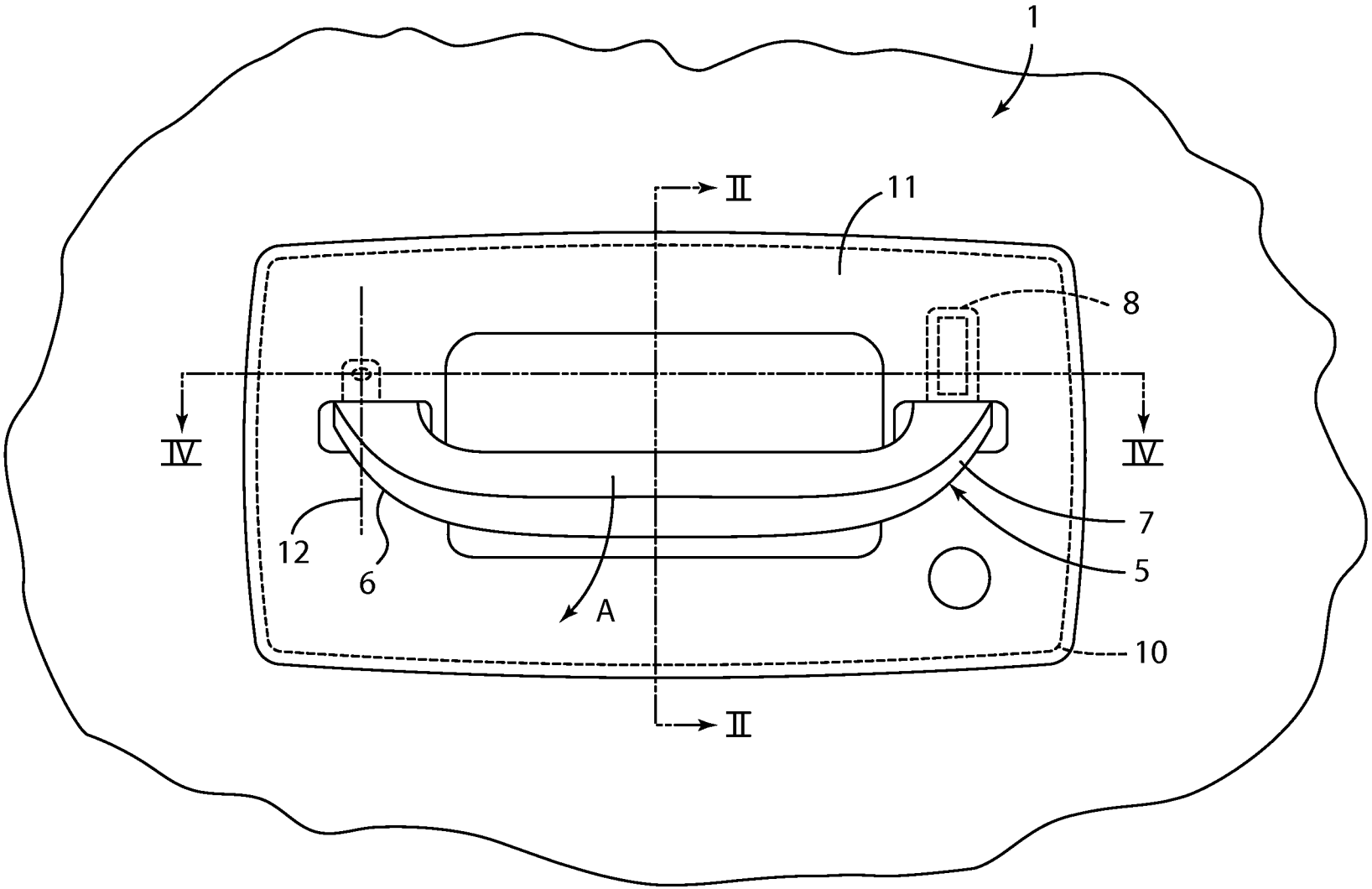
FIG. 1 is a partially fragmentary isometric view of a door handle assembly viewed from outside the vehicle.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle exterior door handle assembly 1 includes a handle strap 5 having a forward end 6 that is rotatably mounted to handle reinforcing structure 10 for rotation about a vertical pivot pin/axis 12. A rearward end 7 of handle strap 5 includes a hook or plunger 8 (see also FIG. 2) that connects to a bellcrank 15 in a known manner. Bellcrank 15 is operably connected to a vehicle latch 16 (FIG. 2) by a mechanical connector such as a rod 17 (or cable) to thereby actuate the latch 16 upon movement of the handle strap 5. Outward rotation of handle strap 5 as indicated by the arrow "A" (FIGS. 1 and 2) rotates bellcrank 15 as shown by the arrow "B" (FIG. 2), thereby releasing latch 16 via rod 17 in a known manner.

Referring again to FIG. 2, bellcrank 15 includes a first arm 20 having a counter-mass 22 rigidly connected to an outer end 24 of first arm 20. Bellcrank 15 also includes a second arm 26 that is operably interconnected with hook or plunger 8 of handle strap 5 in a known manner. Bellcrank 15 pivots about a horizontal pin 28 to thereby rotatably interconnect bellcrank 15 with handle reinforcement structure 10. In the event the handle assembly 1 experiences side acceleration that generates a force acting on handle strap 5 in the direction of the arrow A, a counter force A1 is generated by counter-mass 22, thereby reducing or eliminating the tendency of handle strap 5 to shift outwardly. The construction of counter mass 22 and bellcrank 15 may be of a known design, and will therefore not be further described in detail herein.

Figure 2:
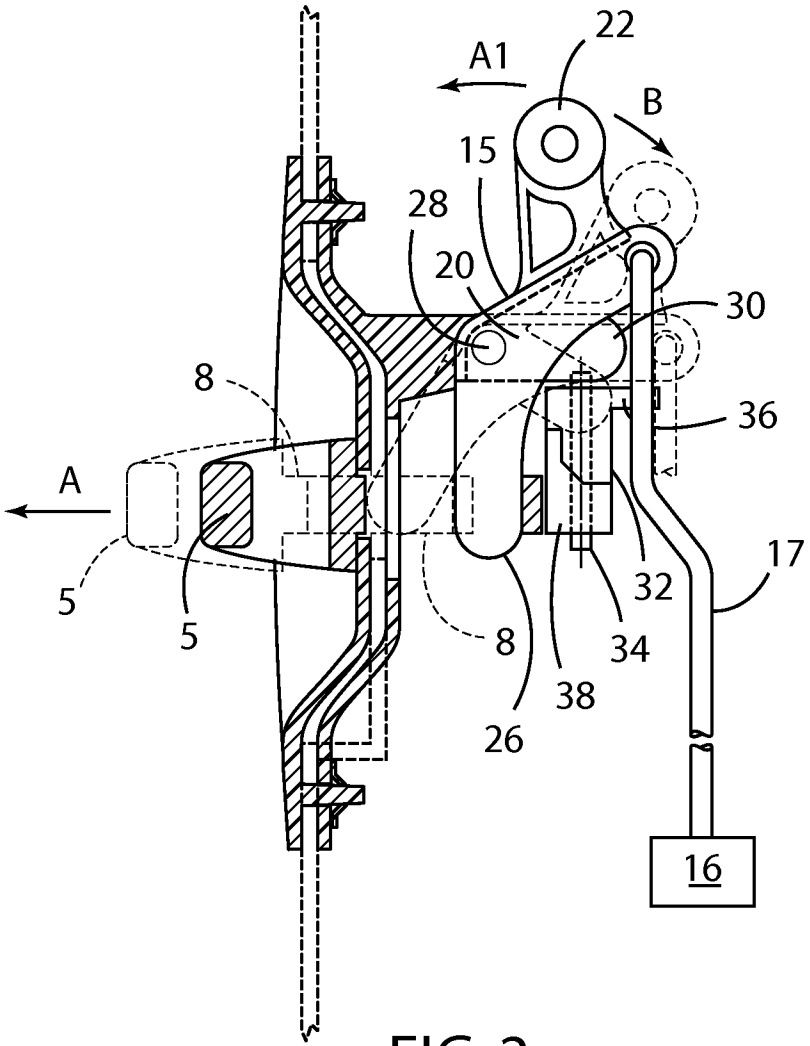
FIG. 2 is a cross-sectional view of the door handle of FIG. 1 taken along the line II-II.
Figure 3:
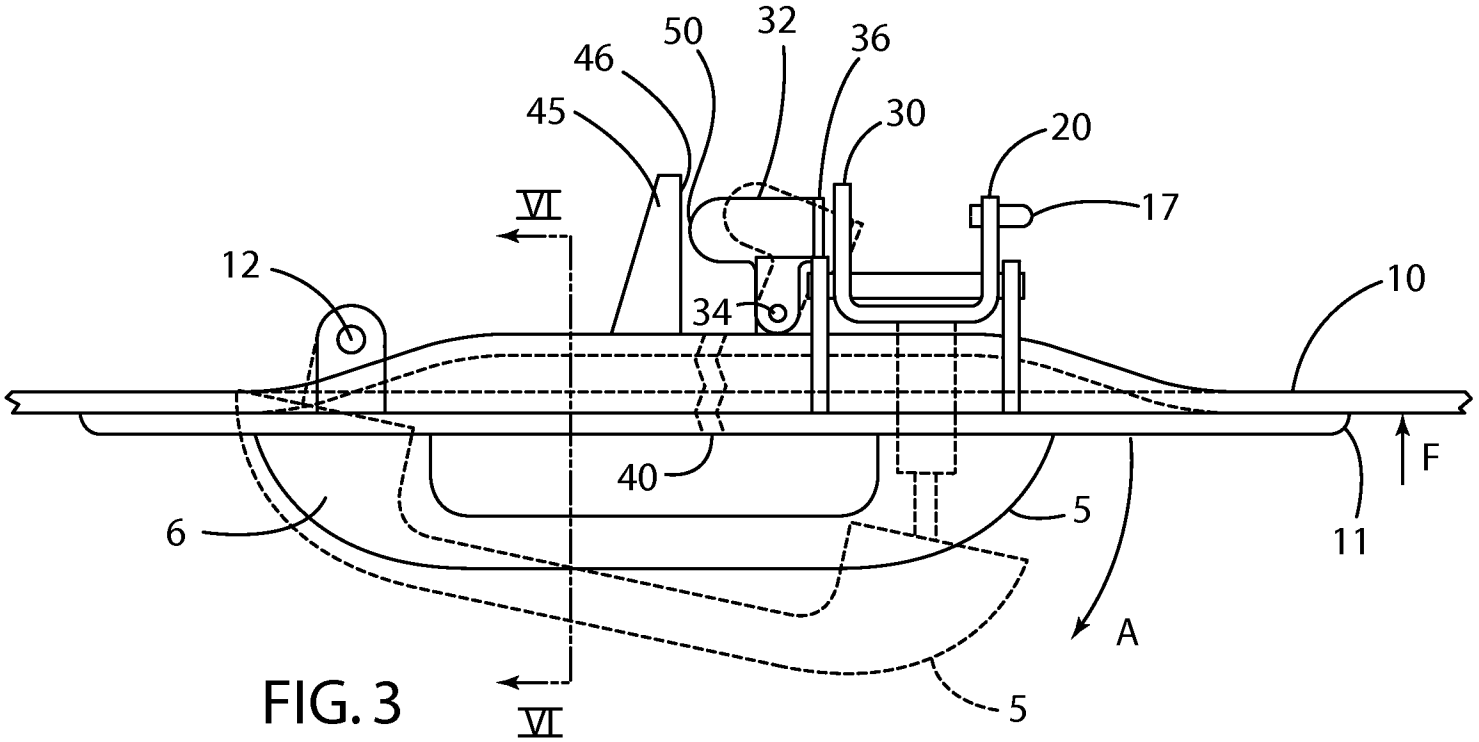
FIG. 3 is a cross sectional view of the vehicle handle of FIG. 1 taken along the line IV-IV.
Figure 4:
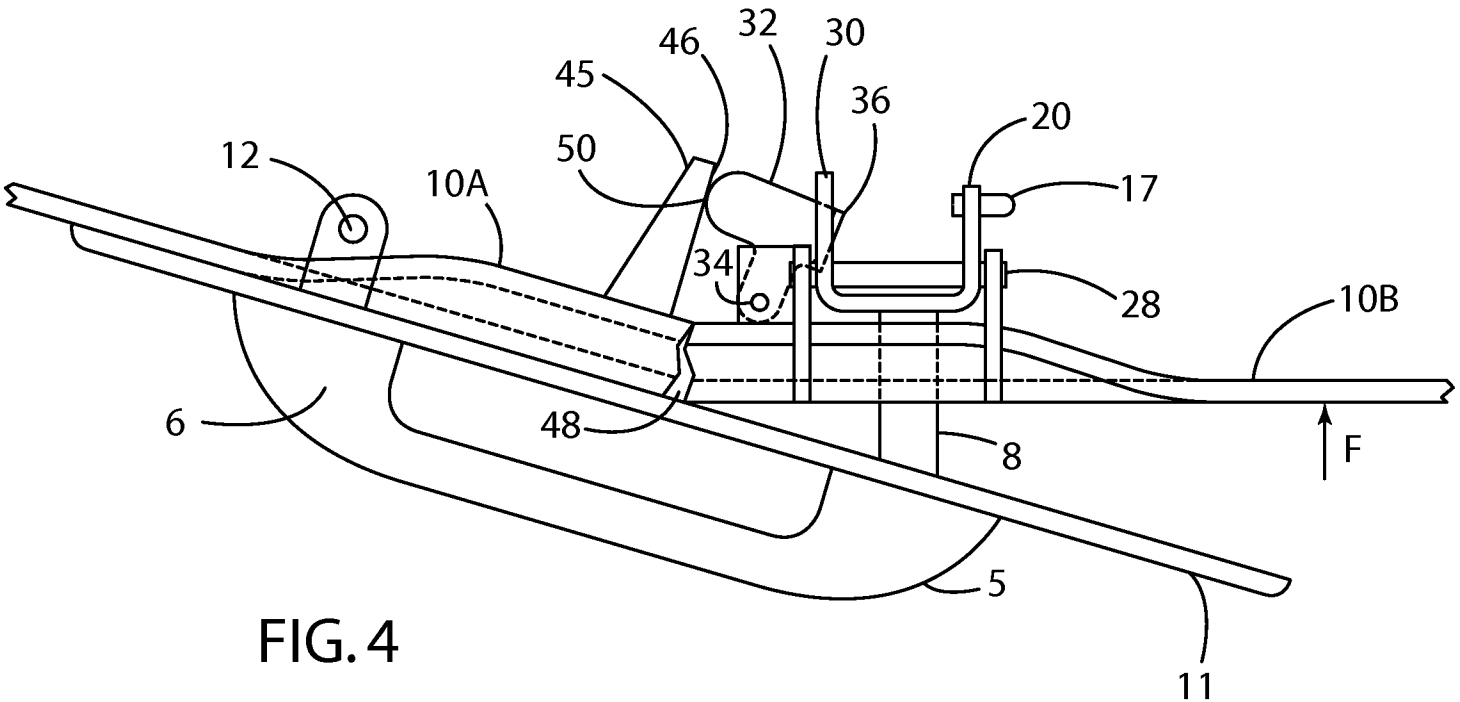
FIG. 4 is a partially fragmentary view of a door handle after fracture of the handle reinforcement structure.
Figure 6:
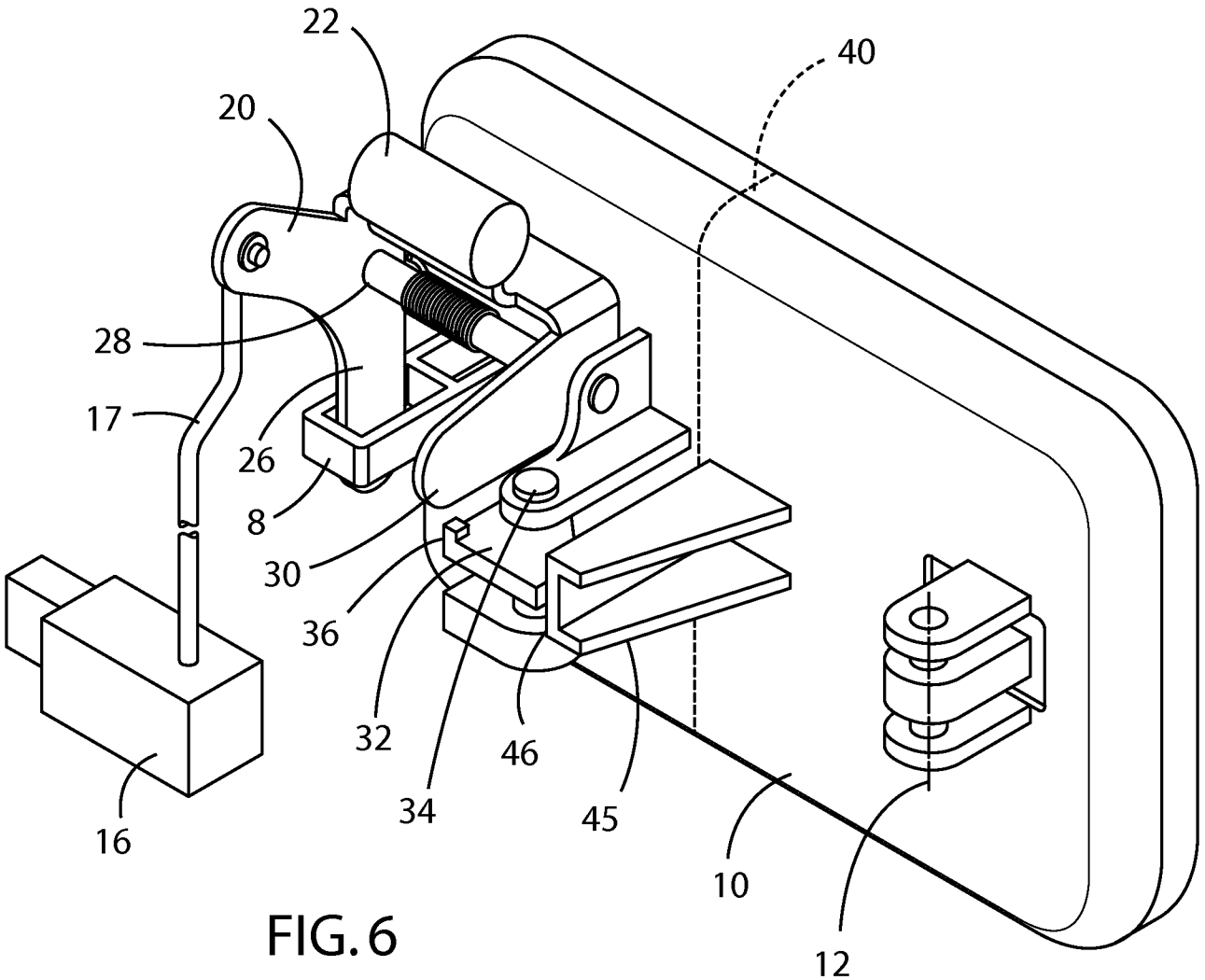
FIG. 6 is a partially fragmentary isometric view of a handle assembly in an intact condition.
Figure 7:
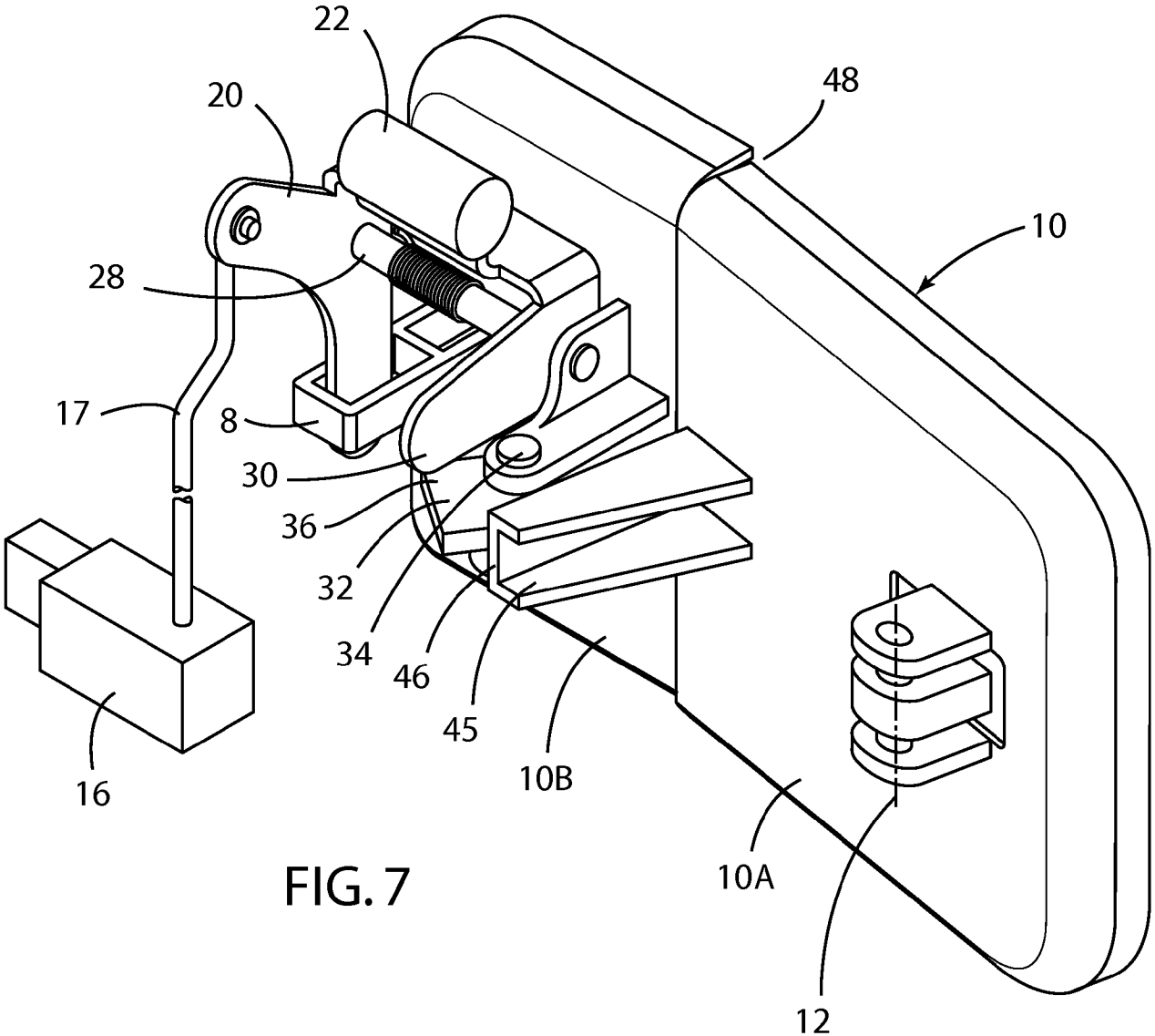
FIG. 7 is a partially fragmentary view of a handle assembly according to the present invention, wherein the bezel has been deformed/broken along a fracture line, thereby driving a push surface into an inertia lock member to thereby cause the inertia lock member to prevent the handle assembly from operating and releasing the latch.

Bellcrank 15 also includes a third arm 30 (see also FIGS. 6 and 7) that comprises a counter-mass lever. Lever 30 is rigidly interconnected with arms 20 and 26, and rotates therewith about pivot end 28. An inertia lock lever 32 is rotatably interconnected to handle reinforcement structure 10 by a pin 34 for rotation about a vertical axis. An extension 36 of inertia lock lever 32 selectively rotates to a position directly adjacent third arm 30 of bellcrank 15 to prevent rotation of bellcrank 15 in the direction of the arrow B. A mass portion 38 of inertia lock lever 32 generates a force tending to pivot the inertia lock lever 32 about vertical axis V if a side acceleration is present, thereby causing the extension 36 to rotate into a blocked or locked position as shown in FIG. 7 wherein the extension 36 prevents downward rotation/movement of third arm 30 of bellcrank 15, thereby preventing rotation of bellcrank 15 in the direction of the arrow "B" (FIG. 2). A spring (not shown) may bias the inertia lock lever 32 in an opposite direction to thereby shift the extension 36 to an unblocked position permitting movement of bellcrank 15 if no side acceleration is present. It will be understood that this aspect of inertia lock lever 32 may be substantially the same as known inertia lock devices.

With further reference to FIGS. 3-7, application of a force F on the handle assembly 1 (when installed in a motor vehicle) will cause handle reinforcement structure 10 to fracture along a fracture line or line of weakening 40 that is designed into handle reinforcement structure 10. After the reinforcing structure 10 fractures, a fracture line or gap 48 (FIG. 4) is formed where the line of weakening 40 (FIG. 3) had been. Reinforcing structure 10 includes an extension 45 having a pushing surface 46. When handle reinforcing structure 10 fractures along line of weakening 40, it forms a first part 10A, and a second part 10B. The second part 10B will tend to rotate relative to the first part 10A to open the gap 48, and handle strap 5 and bezel 11 will tend to remain attached to first portion 10A of handle reinforcing structure 10. As the first and second parts 10A and 10B of handle reinforcing structure 10 rotate, pushing surface 46 of extension 45 contacts end 50 of inertia lock lever 32, thereby driving inertia lock lever 32 into a locked position wherein extension 36 of inertia lock lever 32 locks/prevents rotation of third arm 30 to thereby prevent rotation of bellcrank 15. Thus, in the event the vehicle experiences a side impact in the vicinity of the handle assembly 1, a force F due to the impact will tend to fracture reinforcing structure 10, causing pushing surface 46 to push on inertia lock lever 32 to a locking position to thereby prevent unlatching of latch 16.

Figure 5:
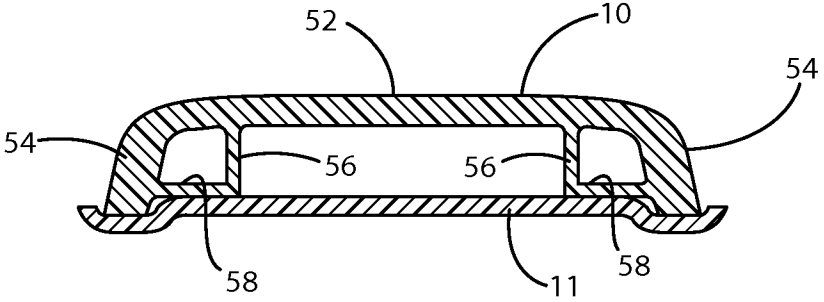
FIG. 5 is a cross sectional view of the handle assembly of FIG. 4 taken along the line VI-VI.

With further reference to FIG. 5, reinforcing structure 10 may include a sidewall 52, and end walls or lips 54. Reinforcing structure 10 may include one or more internal reinforcing ribs 56 and/or reinforcing walls 58 or other such structures. The thicknesses of the sidewall 52 endwall 54, reinforcing rib 56 and/or reinforcing wall 58 may be reduced in the vicinity of the fracture line 40 to create a line of weakening at which the handle reinforcing structure 10 fractures. Also, one or more of the reinforcing structures 56 and 58 may be discontinued in the vicinity of the line of weakening 40 to further ensure that the reinforcing structure 10 fractures along the line of weakening 40 in the event a force F is applied to the handle assembly 1. It will be understood that the reinforcing structure 10 may have a variety of configurations shapes, etc. to accommodate the needs of a particular application. In the illustrated example, the handle reinforcing structure 10 is made of a molded polymer material, as is the bezel 11. However, other materials may also be utilized, depending upon the requirements of a particular application.

The line of weakening 40 and push surface 46 ensure that the inertia lock lever 32 is pushed/shifted into a locked position to prevent unlatching of latch 16 in the event a force F is applied to the vehicle in the vicinity of handle assembly 1. It will understood that the force F may cause fracture of handle reinforcing structure 10 and subsequent locking of inertia lock lever 32 if a sufficient force is present, regardless of whether or not a large lateral acceleration is present.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A door handle assembly for a vehicle door of the type having a latch mechanism to selectively retain the door in a closed position, the door handle assembly comprising:

a handle reinforcement structure configured to be mounted to a vehicle door structure;

an actuating member that can be moved from a first position to an unlatched position to unlatch a latch mechanism;

an inertia lock member movably mounted to the handle reinforcement structure for movement from an unblocked position to a blocked position upon acceleration of the door handle assembly due to a vehicle side impact, wherein the inertia lock member prevents movement of the actuating member to the unlatched position when the inertia lock member is in the blocked position and permits movement of the actuating member to the unlatched position when the inertia lock member is in the unblocked position; and wherein:

the handle reinforcement structure includes a predefined line of weakening and first and second portions on opposite sides of the line of weakening, and wherein the handle reinforcement structure deforms along the line of weakening when forces are applied to the first and second portions of the handle reinforcement structure, the handle reinforcement structure including a pushing surface that contacts the inertia lock member when the handle reinforcement structure deforms along the predefined line of weakening and moves the inertia lock member to the blocking position and thereby prevents movement of the actuating member to the unlatched position.

2. The door handle assembly of claim 1, wherein:

the handle reinforcement structure includes inner and outer opposite sides, and a protrusion extending from the inner side, and wherein the push surface is defined by a side of the protrusion.

3. The door handle assembly of claim 2, wherein:

the protrusion is disposed on the first portion of the handle reinforcement structure, and the inertia lock member is movably mounted to the second portion of the handle reinforcement structure.

4. The door handle assembly of claim 3, wherein:

the inertia lock member is rotatably mounted to the second portion of the handle reinforcement structure.

5. The door handle assembly of claim 4, wherein:

the actuating member is rotatably mounted to the second portion of the handle reinforcement structure.

6. The door handle assembly of claim 5, including:

a handle strap having a first end rotatably mounted to the handle reinforcement structure; and wherein:

the actuating member operably engages a second end of the handle strap such that outward rotation of the handle strap causes the actuator member to rotate from the first position to the unlatched position.

7. The door handle assembly of claim 6, wherein:

the handle reinforcement structure has a generally quadrilateral perimeter including upper and lower edges that extend between vertical side edges, and wherein:

the line of weakening extends from the upper edge to the lower edge.

8. The door handle assembly of claim 7, wherein:

the line of weakening is substantially linear.

9. The door handle assembly of claim 8, wherein:

the handle reinforcement structure defines first and second regions on opposite sides of the line of weakening, the first and second regions defining first and second bending strengths, the handle reinforcement structure defining a third bending strength at the line of weakening, wherein the third bending strength is significantly less than the first and second bending strengths.

10. An exterior door handle assembly for motor vehicles, comprising:

a handle reinforcement structure having inner and outer opposite sides and a peripheral portion extending around the handle reinforcement structure;

a handle member movably mounted to the handle reinforcement structure for movement between open and closed positions, wherein the handle member is configured to be operably connected to a door latch to unlatch the door latch when the handle member is in the open position;

a pushing surface on a first portion of the handle reinforcement structure; wherein:

an inertia lock member movably mounted to a second portion of the handle reinforcement structure and moving from a rest position to an actuated position when subject to acceleration, wherein the inertia lock member permits movement of the handle member from the closed position to the open position when the inertia lock member is in the rest position, and wherein the inertia lock member prevents movement of the handle member to the open position when the inertia lock member is in the actuated position;

the first portion of the handle reinforcement structure defines a first bending strength, and the second portion of the handle reinforcement structure defines a second bending strength; and the handle reinforcement structure includes an intermediate portion disposed between the first and second portions of the handle reinforcement structure and defining a bending strength that is significantly less than the first and second bending strengths such that the intermediate portion of the handle reinforcement structure deforms and causes the pushing surface to contact the inertia lock member and move the inertia lock member to its actuated position when the handle reinforcement structure is subject to a bending force to thereby prevent movement of the handle member to its open position.

11. The exterior door handle assembly of claim 10, wherein:

the intermediate portion comprises a line of weakening.

12. The exterior door handle assembly of claim 11, wherein:

the handle reinforcement structure includes a protrusion extending from the inner side, and wherein the pushing surface comprises a side surface of the protrusion.

13. The exterior door handle assembly of claim 12, wherein:

the protrusion comprises a tapered post member.

14. The exterior door handle assembly of claim 13, wherein:

the protrusion is formed integrally with the handle reinforcement structure.

15. The exterior door handle assembly of claim 14, wherein:

the inertia lock member is rotatably mounted to the second portion of the handle reinforcement structure.

16. The exterior door handle assembly of claim 15, including:

an actuating member rotatably mounted to the handle reinforcement structure and operably engaging the handle member whereby movement of the handle member causes the actuating member to move whereby the actuating member releases a door latch.

17. The exterior door handle assembly of claim 16, wherein:

the handle reinforcement structure has a generally quadrilateral perimeter including upper and lower edges that extend between vertical side edges, and wherein:

the line of weakening extends from the upper edge to the lower edge.

18. The exterior door handle assembly of claim 17, wherein:

the line of weakening is substantially linear.

19. The exterior door handle assembly of claim 18, wherein:

the actuating member is movable from a rest position to an actuated position upon outward movement of the handle member if the inertia lock member is in its rest position; and wherein:

the inertia lock member blocks movement of the actuating member from its rest position to its actuated position when the inertia lock member is in its actuated position.

20. The exterior door handle assembly of claim 19, including:

a bezel structure connected to the handle reinforcement structure, the bezel structure having an outer side surface defining an outwardly facing pocket therein and an inner side that fits closely against the outer side of the handle reinforcement structure, and wherein the handle member comprises a handle strap extending horizontally across the pocket.

* * * * *